US005248195A

United States Patent [19]

Shin

[11] Patent Number: 5,248,195

[45] Date of Patent: Sep. 28, 1993

[54] SEPARABLE BOTTOM MOUNTED DRAWER SLIDE ASSEMBLY

[75] Inventor: Hong M. Shin, Tainan, Taiwan

[73] Assignee: Chern Jia Enterprise Co., Ltd., Tainan, Taiwan

[21] Appl. No.: 925,262

[22] Filed: Aug. 6, 1992

[51] Int. Cl.[5] ..... A47B 88/00

[52] U.S. Cl. ..... 312/334.33

[58] Field of Search ..... 312/334.33, 334.46, 312/334.44, 334.27, 334.36, 334.38

[56] References Cited

U.S. PATENT DOCUMENTS

| | | | |
|---|---|---|---|
| 3,033,639 | 12/1958 | Emery | 312/334.44 |
| 3,589,778 | 6/1971 | Olson | 312/334.46 |
| 4,600,255 | 7/1986 | Dubarko | 312/334.44 |
| 4,993,847 | 2/1991 | Hobbs | 312/334.46 |
| 4,998,828 | 3/1991 | Hobbs | 312/334.46 |
| 5,033,805 | 7/1991 | Hobbs | 312/334.46 |

*Primary Examiner*—Kenneth J. Dorner
*Assistant Examiner*—Janet M. Long
*Attorney, Agent, or Firm*—Bacon & Thomas

[57] ABSTRACT

A bottom mounted drawer slide for, supporting a drawer in a cabinet. The slide assembly is provided with a pawl for enabling the drawer to be removed and to be replaced with a minimum of manipulative effort. The slide assembly incorporates fail-safe features which assure that the assembly latching the drawer channel to the stationary channel is automatically shifted to a locked position responsive to assembly of the channels and is always in a position locked against accidental removal when the channels reach their mutually extended positions.

3 Claims, 4 Drawing Sheets

SEPARABLE BOTTOM MOUNTED DRAWER SLIDE ASSEMBLY

BACKGROUND OF THE INVENTION

1. Field of the Invention

The present invention relates to a drawer slide assembly and more particularly to a bottom mounted drawer slide assembly, i.e. an assembly in which a fixed or cabinet channel is secured beneath a drawer opening and a movable or drawer channel is secured to the bottom of a drawer the latter being, movably mounted in the opening.

2. Description of the Prior Art

U.S. Pat. No. 4,441,772 discloses a drawer slide comprising a fixed channel mounted to a cabinet and a drawer channel secured beneath a drawer. An antifriction means is interposed between the channels to connect the channels for a longitudinal relative movement between telescoped and extended positions. A release mechanism is located adjacent the innermost edge of the drawer and includes a stop member located on the fixed channel and a pawl pivotally mounted to the drawer channel for pivotal movement about a perpendicular axis between first and second limiting positions. A latch surface on the pawl is in the path of the stop member and clear of the stop member in the first and second limiting positions, respectively, of the pawl. A first cam means on the pawl is inwardly positioned relative to the latch surface and disposed in the path of the stop member for co-acting with the stop member to shift the pawl from the first to the second position responsive to inward movement of the first cam past the stop member and a second cam means on the pawl outwardly of the pivot is provided for shifting the pawl from the second to the first limiting position responsive to continued inward movement of said drawer channel relative to the cabinet channel. In the fully extended position of the drawer channel relative to the cabinet channel, the release mechanism can be manipulated to release the drawer for removal. As the release mechanism is located adjacent the innermost edge of the drawer, the user must necessarily place a hand in a supporting position at the rear end of the drawer to prevent inadvertent overturning of the drawer.

While this arrangement has been an improvement over conventional drawer slides, a disadvantage still exists. As described heretofore, the user's hand must necessarily be placed in a supporting position of the rear end of the drawer. Naturally, fingers of the hand must be pressed against the end of bottom of the drawer in supporting the drawer to be removed. It is difficult to reach the flat trip surface of the pawl with one of these fingers without looking at the bottom side of the drawer. Even if this is accomplished, it is inconvenient to shift the pawl from its first, to second limiting position with one finger of the hand which is supporting the drawer.

SUMMARY OF THE INVENTION

Accordingly, it is an object of the invention to provide a drawer slide which can diminish the disadvantage of a known drawer slide.

It is another object of the invehtion to provide a drawer slide with a construction allowing for an easy release operation to permit drawer removal.

With the above objects in view, the present invention provides a slide assembly which obviates the prior art inconvenience and is characterized in the provision of a novel lock mechanism which, in the fully extended position of the drawer channel relative to the cabinet channel may be easily manipulated to smoothly release the drawer for removal. The release mechanism is located adjacent the innermost edge of the drawer and the user disposes a hand in a supporting position at the rear end of the drawer, thus precluding inadvertent overturning of the drawer.

The latch assembly includes a novel pawl and stop mechanism whereby the latch is positively shifted to a drawer locking position when it reaches its fully extended position whereby the drawer slide is dependably locked against further outward movement unless the position of the pawl is manually shifted.

DETAILED DESCRIPTION OF THE PREFERRED EMBODIMENT

Figure 1:
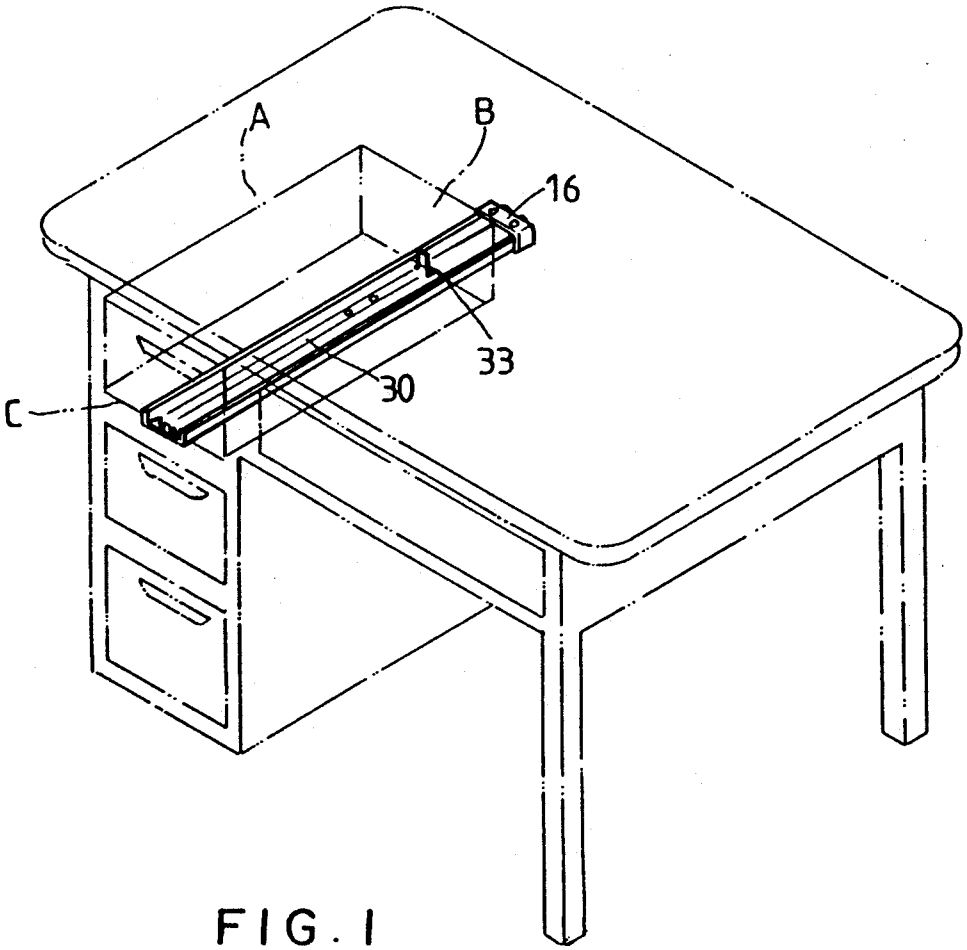
FIG. 1 is a perspective view of a drawer slide assembly according to the present invention shown in conjunction with a desk, the desk being illustrated in phantom.
Figure 2:
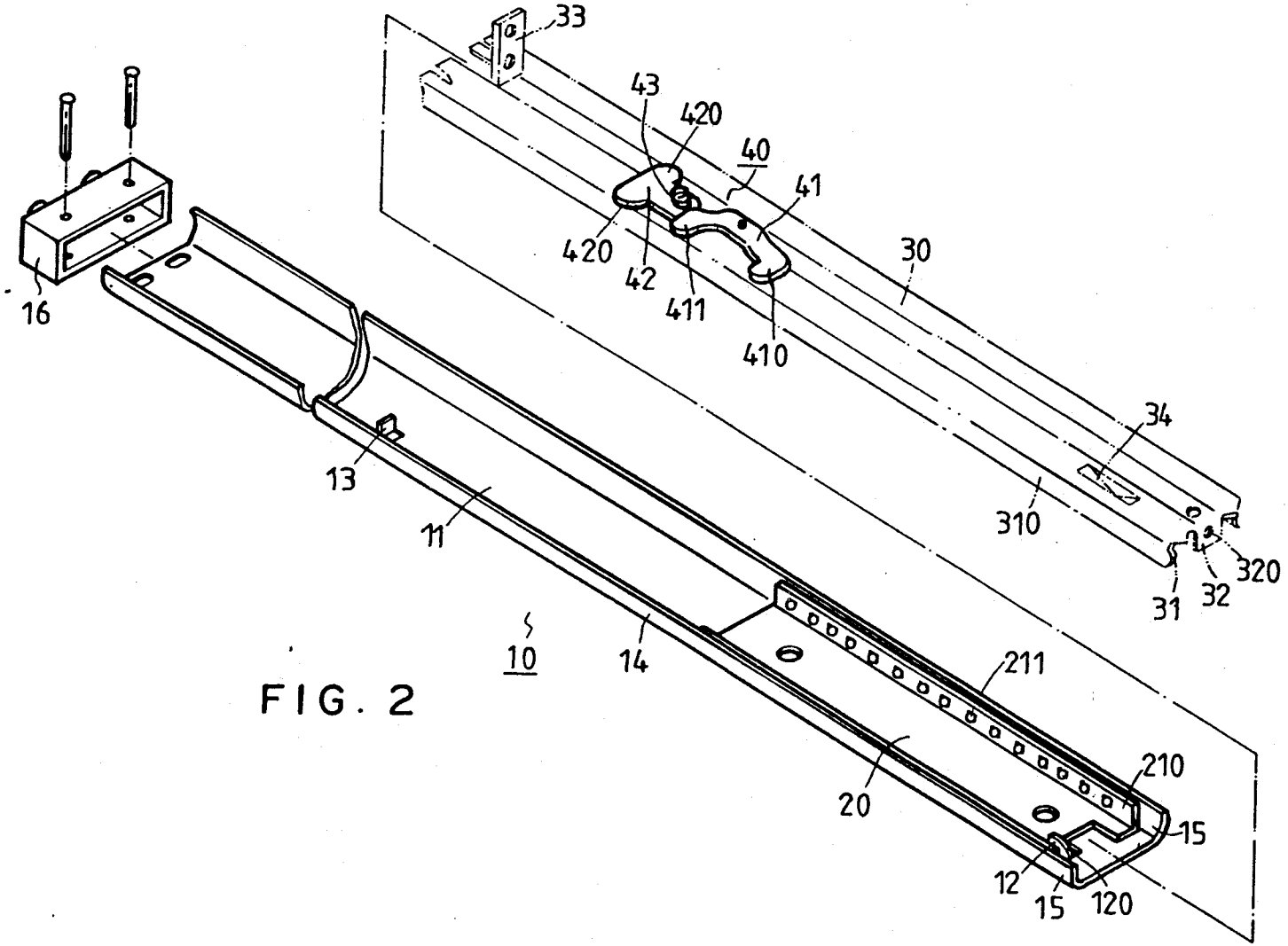
FIG. 2 is an exploded perspective view of the drawer slide assembly.
Figure 3:
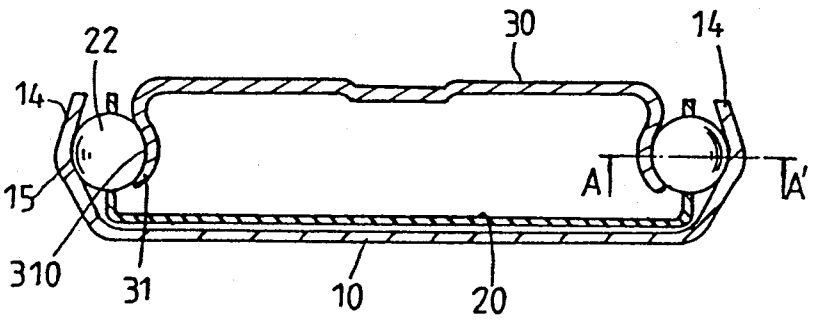
FIG. 3 is a cross-sectional view of the drawer slide assembly shown in an assembled condition.

Referring now to FIGS. 1, 2 and 3, a drawer slide assembly according to the present invention comprises a cabinet mounted channel 10, a drawer mounted channel 30 and a ball retainer 20 located between the two channels 10, 30.

Figure 4:
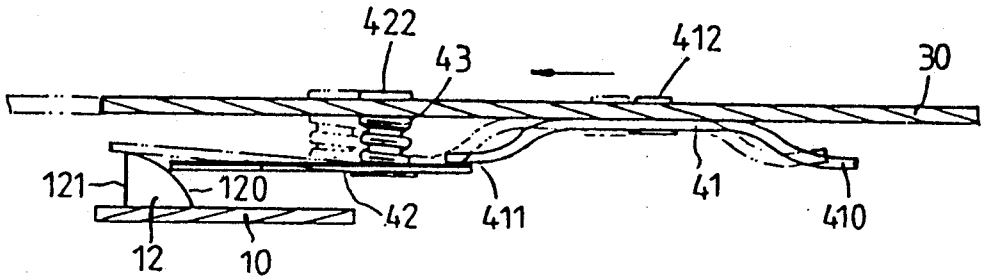
FIG. 4 a fragmentary view showing two positions of a latch mechanism during initial return movement of the drawer channel into the cabinet channel.
Figure 3A:
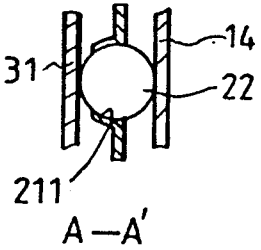
FIG. 3A is a sectional view taken along line A—A' of FIG. 3.
Figure 5:
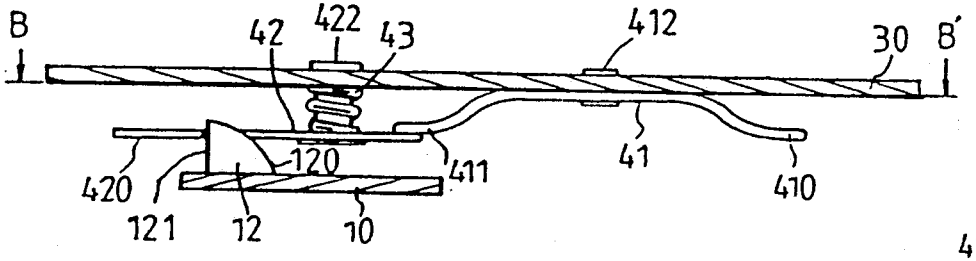
FIG. 5 is a fragmentary view of the latch mechanism showing the drawer located in a fully extended position.
Figure 7:
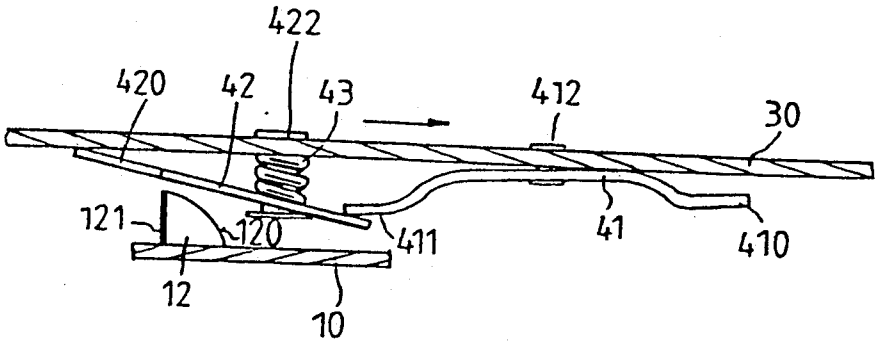
FIG. 7 is a fragmentary view showing the position of the parts when the latch mechanism has been tripped to permit removal of the drawer.

The cabinet channel 10 is generally U-shaped in cross section with two upwardly directed legs 14, which are curved at 15, defining a longitudinal trough 11. A socket member 16 adapted to receive the inner end of the cabinet channel 10 is provided for securing the same to a portion of the cabinet B within which the drawer A is mounted. The forward end of the cabinet channel 10 is fastened to a portion C of the cabinet B so as to support the cabinet channel 10 in a horizontal orientation. Within the longitudinal trough 11, there is provided a rear stop member 13 adjacent the inner end of the cabinet channel 10 and a front stop member 12 which consists of a convex or sloped side wall 120 close to the forward end of the cabinet channel 10 and a vertical side wall 121 substantially perpendicular to the longitudinal direction of the trough 11 and opposite to the convex or slope side wall 120, as best shown in FIGS. 4, 5 and 7.

The ball retainer 20 is disposed in the longitudinal trough 11 of the cabinet channel 10 and is generally U-shaped in section with two upwardly directed legs 210 each of which is formed with a plurality of evenly spaced and aligned ball retaining apertures 211 for mounting a plurality of steel balls 22.

The drawer mounted channel 30 is generally in the form of an inverted U-shape, including a central web and depending legs 31 and is secured beneath the drawer A by a bracket member 33 extending from the web at the inner end portion of the drawer channel 30 for securing the same to a rear side wall of the drawer A. A lip 32 is integrally formed on the forward end of the channel 30 and has a screw hole 320 provided for mounting the forward end of the channel 30 behind a front wall of the drawer A by means of a screw (not shown). The legs 31 of the drawer channel 30 each curve inwardly at 310 to define a pair of rails. The respective legs 14, 31 of the cabinet and drawer channels 10, 30 are so constructed as to engage and provide sliding support for the balls 22, which are mounted in the ball retainer 20. As will be understood, the balls 22 act to permit the channels 10, 30 freely to slide relative to each other. A spring 34 is curved from the web of the drawer channel 30 into the path of the front stop member 12 for the purpose of providing a frictional brake to the channel 30 in a manner is to be discussed later.

The principle advance of the present invention is directed to the latch mechanism which is comprised generally of a pawl device 40 mounted to the web of the drawer channel 30 and the front stop member 12 formed from the body of the cabinet channel 10 as previously described.

Figure 6:
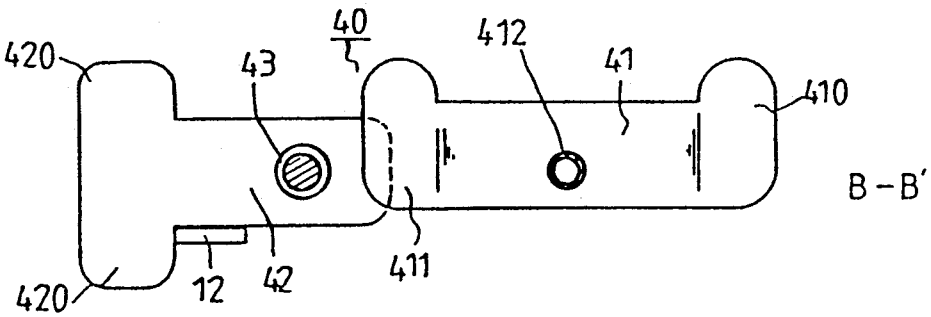
FIG. 6 is a sectional view taken along line B—B' of FIG. 5.

Referring to FIGS. 4, 5 and 6, the pawl device 40 includes an actuating lever 41 pivotally mounted under the web of the drawer channel 30 by means of a rivet 412 which functions as a fulcrum and a pawl member 42 also pivotally mounted under the web of the drawer channel 30 by means of a rivet 422 through a coil spring 43 which is mounted on the rivet 422 and disposed between the web of the channel 30 and the pawl member 42 so as to keep the pawl member 42 a proper distance apart from the web of the channel 30. The actuating lever 41 extends correspondingly from the rivet 412 downwardly then outwardly along the longitudinal direction of the channel 30 to define a frontal trip end 410 and a rear push end 411 which lays on the front end of the pawl member 42. The rear end of the pawl member 42 is integrally formed with two wings 420 which extend laterally along a direction perpendicular to the longitudinal direction of the channel 30.

It is important to note that the construction of the channels 10, 30 and the interconnection among the channels 10, 30 and ball retainer 20 permits free sliding movements between the ball retainer 20 and cabinet channel 10 and between the drawer channel 30 and ball retainer 20.

In assembly, as shown in FIG. 4, the drawer channel 30 is inserted into the cabinet channel 10 through the ball retainer 20, the pawl member 42 is automatically tilted until the wing 420 of the pawl member 42 passes the front stop member 12 and thereafter the drawer can be shifted further inwardly to its mounted position. The ball retainer 20 is slidable between the front and rear stop members 12, 13. In progressively moving inwardly relative to the cabinet channel 10, the rear stop member 13 initially blocks further inward movement of the ball retainer 20, while the drawer channel 30 may still move slightly further inwardly relative to the ball retainer 20. As the spring 34, shown in FIG. 2, is curved downwardly into the path of the front stop member 12, when the drawer is shifted into its innermost position, whereas the wing 420 of the pawl member 42 is blocked by the rear stop member 13. The convex or slope side wall 120 of the front stop member 12 engages against the curved spring 34 which provides a frictional brake to the drawer channel 30 for preventing the same from striking on the rear stop member 13 and maintaining the drawer in its fully closed or innermost position.

In operation, when the drawer is pulled outwardly to its fully extended position, as shown in FIGS. 5, 6, the wing 420 engages against the vertical side wall 121 of the front stop member 12 to block further outward movement of the drawer. Should it be desired to remove the drawer, it is merely necessary to tilt the pawl member 42 by the push end 411 of the actuating lever 41 when the trip end 410 is pressed toward the web of the channel 30 with a finger, as shown in FIG. 7, whereby the wing 420 of the pawl member 42 is disengaged from the front stop member 12, thus enabling the drawer to be removed.

From the foregoing it will be recognized that there is described in accordance with the invention a bottom mounted drawer slide assembly wherein the drawer may be readily removed from the cabinet but which removal procedure can be accomplished only after manual tripping of the pawl member 42.

Unlike the drawer slide assembly disclosed by U.S. Pat. No. 4,441,772, the release control of the latch mechanism is operated by the pivotally mounted actuating lever 41 so that the user can press the trip end 410 of the actuating lever 41 upwardly with a finger of one hand while the other hand is also ready to support the drawer for removal.

What is claimed is:

1. A separable bottom mounted drawer slide assembly comprising:

a) a fixed channel for mounting to a cabinet, the fixed channel including an inner end and an outer end;

b) a movable channel for mounting to a drawer, the movable channel including an outer end portion for disposition adjacent a front wall of the drawer and an inner end portion;

c) antifriction means interposed between the fixed and movable channels and connecting the channels for relative longitudinal movement between extended and retracted positions;

d) a self-coupling lock mechanism for connecting and disconnecting the fixed and movable channels, the lock mechanism including a stop member on the fixed channel adjacent the outer end thereof and defined by a sloped side wall facing the outer end of the fixed channel and a vertical sidewall facing the inner end of the fixed channel, a pawl on the movable channel having a first end adjacent the inner end portion of the movable channel and a second end remote from the first end of the pawl, the pawl being mounted for pivotal movement between first and second positions about an axis intermediate the first and second ends thereof, a wing member carried by the first end of the pawl for engaging and clearing the stop member in the first and second positions of the pawl, a first spring disposed between the pawl and the movable channel fir biasing the maintaining the pawl in the first position , an actuating lever member on the movable channel having a first end engaging the second end of the pawl and a second end remote from the first end of the lever member, the lever member being mounted for pivotal movement about an axis intermediate the first and second ends of the lever member; and e) whereby when the second end of the lever member is pressed by the finger of a user, the first end of the lever member pivots the pawl to cause the wing member to clear the vertical side wall of the stop member and permit separation of the movable channel from the fixed channel and removal of the drawer from the cabinet.

2. The drawer slide assembly of claim 1 wherein the axes intermediate the first and second ends of the pawl and lever member are both perpendicular to the direction of relative longitudinal movement between the fixed and movable channels.

3. The drawer slide assembly of claim 1 further including a second spring carried by the movable channel for frictional engagement with the sloped sidewall of the stop member to limit the retraction of the movable channel relative to the fixed channel.

* * * * *